US005575985A

United States Patent [19]

Klotz et al.

[11] Patent Number: 5,575,985

[45] Date of Patent: Nov. 19, 1996

[54] PREPARATION OF STABLE GRAPHITE

[75] Inventors: Helmut Klotz, Bergisch Gladbach; Hans D. Pinter, Wermelskirchen, both of Germany

[73] Assignee: Bayer Aktiengesellschaft, Leverkusen, Germany

[21] Appl. No.: 440,031

[22] Filed: May 12, 1995

[30] Foreign Application Priority Data

May 20, 1994 [DE] Germany ..... 44 17 744.5

[51] Int. Cl.[6] ..... C01B 31/04; C09C 1/56

[52] U.S. Cl. ..... 423/448; 423/460

[58] Field of Search ..... 204/294, 128; 423/448, 460; 205/618, 620, 638

[56] References Cited

U.S. PATENT DOCUMENTS

| | | | |
|---|---|---|---|
| 2,837,412 | 6/1958 | Bennett | 423/460 X |
| 3,242,065 | 3/1966 | De Nora et al. | 204/294 X |
| 3,375,132 | 3/1968 | Geise | 204/294 X |
| 3,580,824 | 5/1971 | Currey et al. | 204/294 X |
| 3,814,699 | 6/1974 | Baldieri et al. | 204/294 X |
| 3,847,862 | 11/1974 | Gotshall | 423/460 X |
| 4,663,010 | 5/1987 | Debrodt et al. | 204/293 |

FOREIGN PATENT DOCUMENTS

| | | |
|---|---|---|
| 0021456 | 1/1981 | European Pat. Off. . |
| 0040897 | 12/1981 | European Pat. Off. . |
| 205631 | 2/1987 | European Pat. Off. . |
| 1208508 | 2/1960 | France . |
| 2140599 | 1/1973 | France . |
| 3725 | 4/1953 | Germany . |
| 1216852 | 5/1966 | Germany . |

OTHER PUBLICATIONS

Ullmanns Encyclopedia of Industrial Chemistry, vol. A6, pp. 459–461 (1986).

R. Minz, Chemie, Anlagen Verfahren, pp. 77–78 (1992).

Winnackei–küchlei, Chemische Technologie I, pp. 278–281 (1969).

P. Gallone, et al., Electrochemical Technology, vol. 3, pp. 321–326 (1965).

*Primary Examiner*—Donald R. Valentine

*Attorney, Agent, or Firm*—Sprung Horn Kramer & Woods

[57] ABSTRACT

In the preparation of a graphite body suitable for use as a cathode in an electrolytic process, comprising the steps of a) contacting a graphite body with a solution in at least one polyhydric alcohol having 2 to 4 carbon atoms of at least one of an iridium salt and rhodium salt for a time sufficient for the solution to penetrate through the surface of the graphite body to a depth of at least about 1 mm, and b) heating and then cooling the graphite body, the improvement which comprises effecting the heating by contacting the surface of the graphite body into which the solution has penetrated with a naked gas flame positioned above such surface, the graphite body being heated to about 200° to 450° C. for about 2 to 10 minutes.

6 Claims, 3 Drawing Sheets

PREPARATION OF STABLE GRAPHITE

The invention relates to a process for preparing stable graphite cathodes and the use of these cathodes for the electrolysis of hydrochloric acid.

The process for the industrial electrolysis of hydrochloric acid is described in Ullmanns Encyclopedia of Industrial Chemistry vol. A 6, page 459 (1986). A fabric diaphragm or a cation-exchange membrane is located in the electrolysis cell between graphite electrodes (Minz, Chemie, Anlagen, Verfahren (1992) p. 77). The addition of specific salts to the catholyte, e.g. salts of Pt, Pd, Cu, Ni, Sb, Ag, Mo or Co, can lower the cell voltage (DE-AS 1,216,852, FR-A 1,208,508, DD 3,725).

In operational practice, noble metal compounds from the platinum group are added to the electrolyte, which achieves a voltage drop of 300 to 500 mV (Winnacker-Küchler, Chemische Technologie I p. 280 (1969)).

The type of voltage drop which is produced in this way, however, is not permanent, so continuous or batchwise addition of noble metal salts has to be maintained (DE-AS 1,216,852).

According to the conventional construction of the electrolyzers for hydrochloric acid, the catholyte, together with hydrogen gas, and the anolyte, together with chlorine gas, are withdrawn at the top of the cell in the channels which are supplied for this purpose. After that, a gas/hydrochloric acid separation has to be performed and the hydrochloric acid is again saturated with hydrogen chloride gas and returned to the cell.

It is assumed that noble metals or dissolved noble metals are also drawn out of the cell with the electrolyte/gas mixtures and that these are therefore distributed over the whole system. Recovery of the noble metals is not described in the literature for hydrochloric acid electrolysis. It is also not justifiable for economic reasons, because the noble metals are uniformly distributed as a deposit over the whole of the apparatus which is connected in series with the cell.

In a publication by Gallone and Messner, Electrochemical Technology 3 (1965) 321 to 326, it is mentioned that noble metal losses may be avoided by treating the surface of the graphite electrodes with an 80% Pt/20% Ir alloy, this alloy being deposited in an amount of 12.4 g/m$^2$. This measure is designated as being of "small advantage" by Gallone and Messner themselves. The coating method itself is not described and it is not stated whether coating takes place before installation of the electrodes or, as is conventional in practice, by in-situ addition of noble metal salts during electrolysis.

Spray coatings and the vapor deposition of metals onto graphite are described in DD-3,725 in order to lower the cell voltage. The only very limited durability is attributed to the fact that adhesion of the metal crystals is not good enough and these break away from the surface of the graphite too easily.

EP-A 205,631 describes a process for coating graphite bodies which are used as a cathode in electrolysis by soaking the surface of a graphite body with a solution of a platinum salt and another metal salt in alcohol and then heating to 250° to 600° C. Ethanol, propanol and butanol are mentioned as preferred alcohols. Heat treatment is of the type such that the entire graphite body is heated to the temperatures mentioned. During the heating up phase, the alcohol is partially evaporated so that it is no longer available for reaction. A waste gas unit must be connected in series with the furnace in which the graphite body is subjected to heat treatment in order to degrade the oxidation products of the alcohol.

It is accordingly desirable to provide a process for preparing electrodes, in particular for hydrochloric acid electrolysis, which permits the production of stable, corrosion-resistant, abrasion-resistant electrodes with a low overvoltage and which is simple and cost effective.

This object can be achieved by means of the process according to the invention.

The invention provides a process for preparing graphite cathodes for electrolytic processes, in particular for HCl electrolysis, wherein a solution of iridium salts or rhodium salts or mixtures of iridium salts or rhodium salts with salts of other metals from the platinum group, consisting of platinum, palladium, osmium and ruthenium, in mono or polyhydric alcohols with 2 to 4 carbon atoms or in mixtures of mono or polyhydric alcohols with 2 to 4 carbon atoms, is introduced into the pores in the graphite body before its use as a cathode. The graphite is then optionally rinsed with mono or polyhydric alcohols with 2 to 4 carbon atoms or mixtures of mono or polyhydric alcohols with 2 to 4 carbon atoms, then heated and subsequently cooled. Heating of the soaked graphite body is effected with naked gas flames at the surface soaked with the solution to a depth of up to about 1 mm to temperatures between about 200° and 450° C. for about 2 to 10 minutes, preferably 4 to 6 minutes, the gas flames acting only from above vertically downwards onto the soaked graphite body when the entire soaked graphite body is located underneath the gas flames.

A preferred variant of the process consists of introducing the salts mentioned above or the salt mixtures mentioned above to the pores in the graphite body in 1,2-ethanediol or in glycerine and optionally rinsing with 1,2-ethanediol or glycerine.

After heating with naked gas flames and after cooling, the graphite body may be treated again with pure mono- or polyhydric alcohols with 2 to 4 carbon atoms, then subjected to the gas flame treatment again and then cooled.

The naked gas flames also serve to consume, i.e. oxidize, any excess polyhydric alcohol present on the graphite.

Operating below the recited rantes of time, temperature and depth of penetration will generally not produce the desired result. Operating above such values is generally wasteful and in some instances also gives poorer results.

The noble metals or alloys mentioned above are preferably present in an amount of about 5 to 20 g per projected area of 1 m$^2$.

Graphite cathodes prepared according to the invention are preferably used for the electrolysis of hydrochloric acid in cells with diaphragms or ion-exchange membranes.

The use of graphite cathodes prepared according to the invention is particularly preferred for the electrolysis of hydrochloric acid where a minimum current of about 0.1 to 1.5 mA/cm$^2$, preferably 0.5 to 0.75 mA/cm$^2$ is maintained during stoppage of electrolysis in the cells.

The starting material used is graphite cathodes which are commercially available and which consist of special electrode graphite (graphite for technical electrolytic processes) such as, for instance, AC quality graphite from COVA/CONRADTY, Nürnberg, or ES and EH quality graphites from SIGRI, Meitingen. This type of graphite material generally has an inherent porosity (total pore volume) of 12 to 18%, a specific resistance of 7.5 to 12.5 Ω mm$^2$/m, and an apparent density (bulk density) of 1.70 to 1.77 g/cm$^3$. Electrode graphite is produced by means of generally known petrochemical, ceramic and finishing steps, wherein the material-specific porous surface structure is produced.

In comparison with the prior art, graphite cathodes prepared according to the invention have a high resistance to corrosion and an extraordinarily long lifetime, wherein the voltage lowering effect is retained over the entire lifetime. In addition, the process according to the invention is very energy-effective and simple to perform. An associated waste gas processing unit is not required.

In-situ coating and also electrolytic pre-coating in neutral medium according to the prior art leads to electro-crystallization of the noble metals on the external surface of the graphite, wherein these crystal agglomerates are not bonded to the graphite, either chemically or physically, but are only loosely deposited and thus easily break off. In addition, in the case of in-situ coating, deposition of noble metals takes place at preferred sites on the graphite surface, so that the desired uniform distribution of noble metal is not achieved. Spray coating according to the prior art, for example using a plasma burner, leads to coverage of the large graphite surface which has large numbers of pores and cracks, so that a cathode with a low surface area is produced and the metal layer easily flakes off.

Instead of depositing metal on the surface of the graphite body, the process according to the invention enables the production of graphite cathodes in which the metals are firmly anchored (sealed) in the pores and cracks in the graphite.

Furthermore, the total heating period amounts to only about 2 to 10 minutes, preferably 4 to 6 minutes, and only carbon dioxide and water vapor are produced as waste gases. If the dimensions of an industrial electrolyzer with graphite electrodes, 1.50×0.35×0.07 m for instance, are considered, wherein an individual electrolyzer is constructed from more than 100 of this type of electrode, the savings potential provided by the process according to the invention is obvious.

The invention will be further described with reference to the accompanying drawings wherein.

Figure 1:
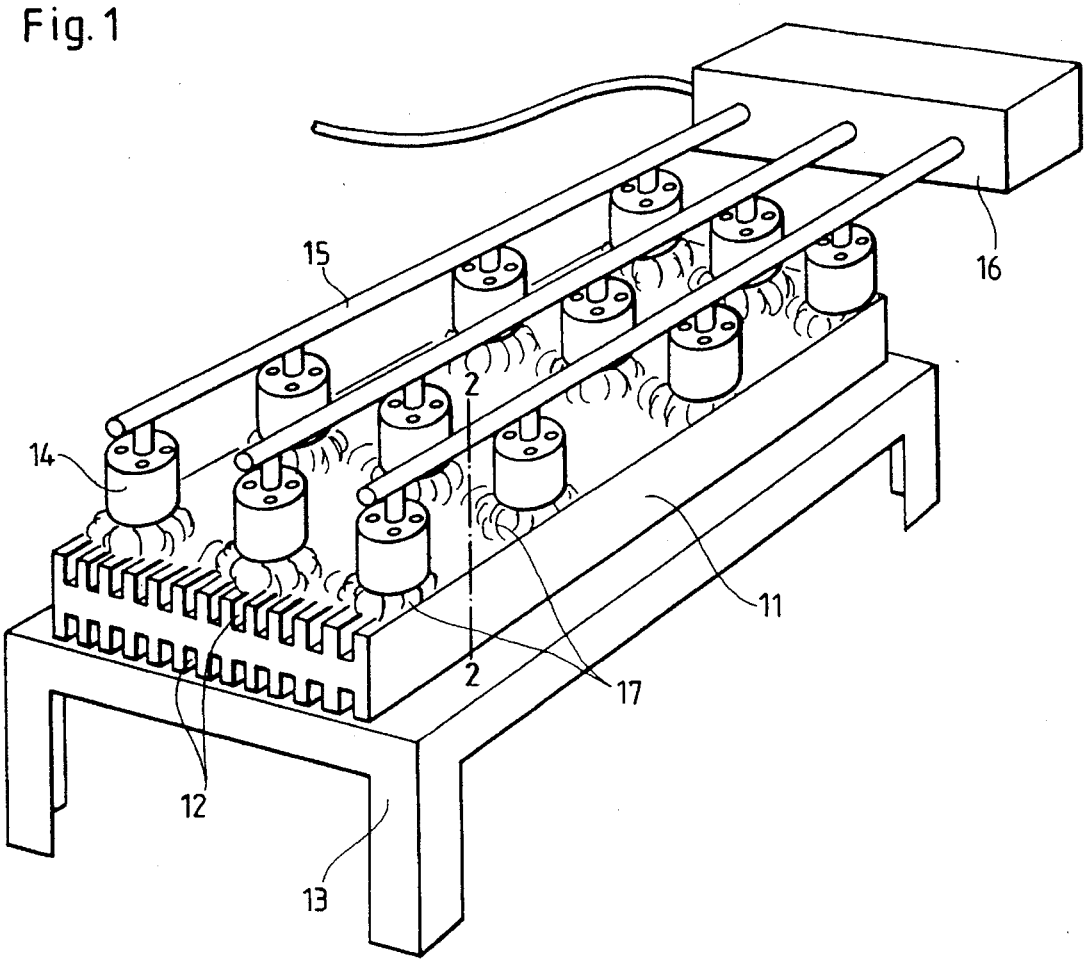
FIG. 1 is a perspective view of an apparatus for carrying out the instant process.
Figure 2:
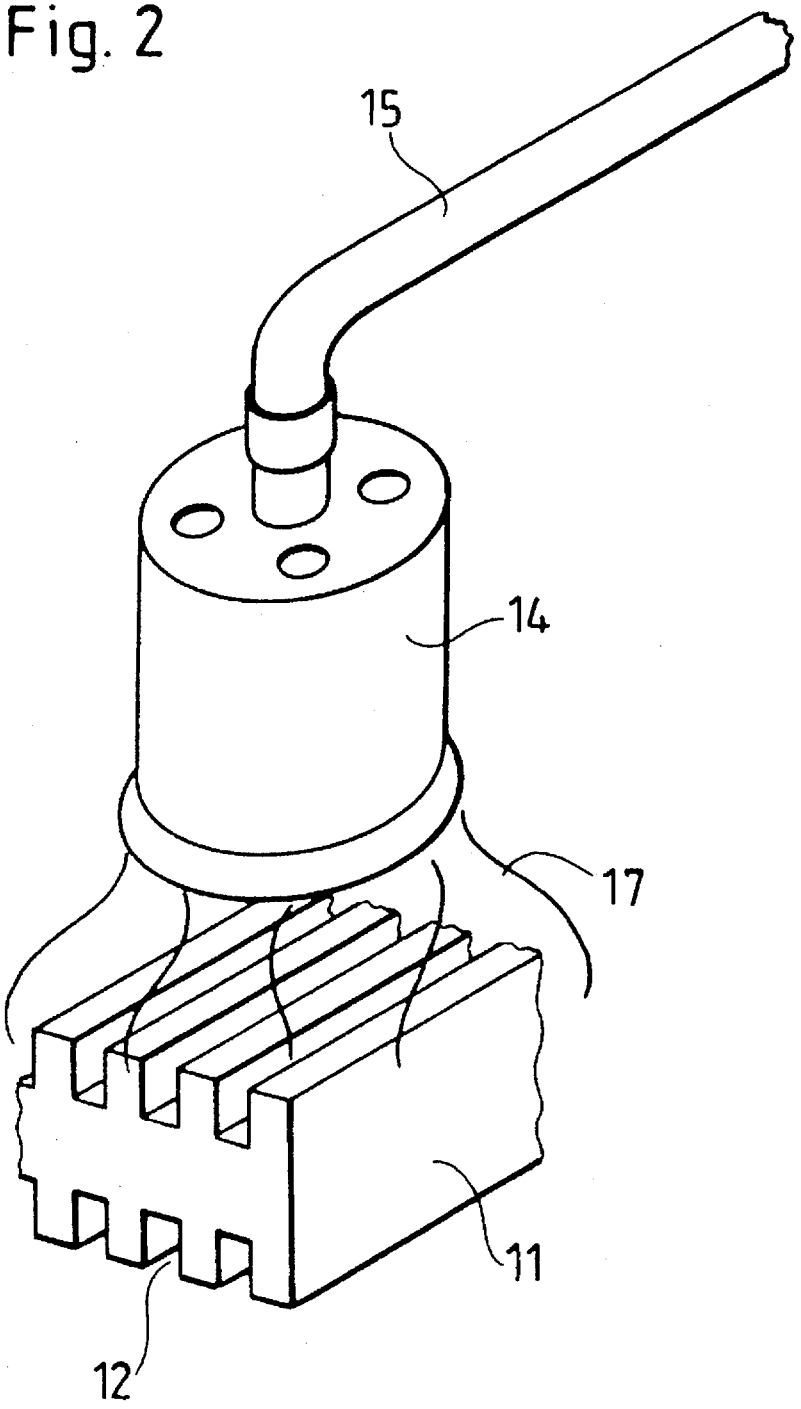
FIG. 2 is an enlarged view of a portion of the structure of FIG. 1.

Referring now more particularly to the drawing, FIG. 1 shows an arrangement which can be used for the process according to the invention. The soaked electrode plate of graphite 11 is provided with longitudinal slits 12 and is lying on a bench 13. Gas burners 14 are arranged over the plate 1 and these are provided with combustible gas (e.g. a propane/butane mixture) via piping 15. Control and safety devices are accommodated in housing 16. The gas pressure and distance of the gas burners from the graphite plate are adjusted so that the gas flames 17 completely cover the graphite surface.

The burners used are advantageously those which are usually used for the application of bitumen sheeting in the roofing trade.

The graphite sheet is placed under the gas burners before the gas burners are ignited.

The invention is explained in more detail by means of the following examples.

EXAMPLE 1

(comparison example)

Figure 3:
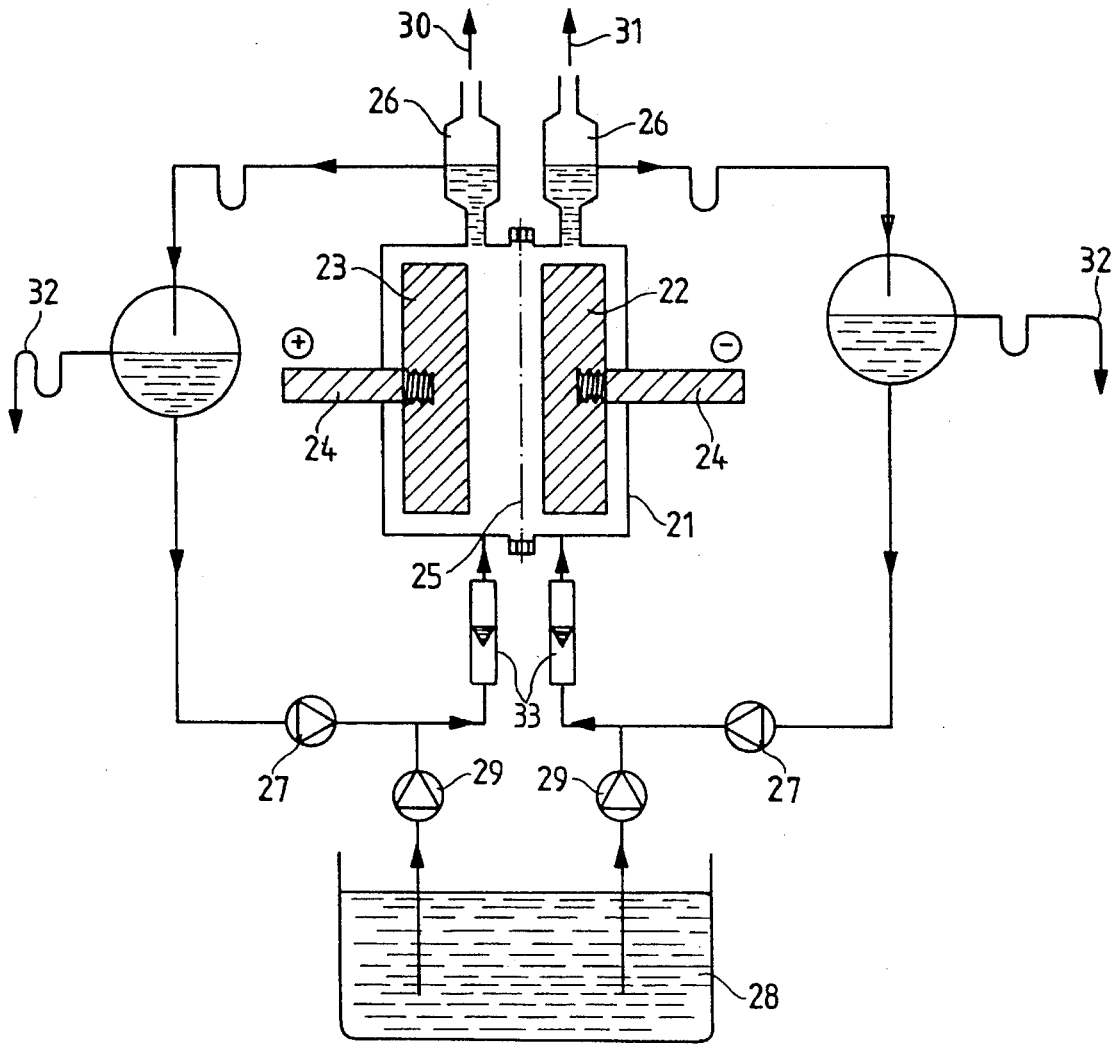
FIG. 3 is a flow sheet of a known cell for electrolysis of hydrochloric acid.

Hydrochloric acid was electrolyzed in an electrolysis cell with a diaphragmas shown in FIG. 3 using uncoated graphite electrodes with a surface of 110×73 mm and 50 mm thick, and an internal forced circulation of 0.1 l/h in both electrode chambers. 21 represents the cell housing of polypropylene. The cathode 22 and the anode 23 are sealed into the housing with current-carrying bolts 24. The two halves of the cell are separated by a diaphragm (or a cation-exchange membrane) 25. The electrolyte can be circulated by pumps 27 into both halves of the cell by varying the rate of flow through flowmeters 33. This circuit is fed with fresh 30% strength hydrochloric acid 28 via pumps 29. The gases 30, 31 and the depleted electrolyte 32 leave the cell via the gas/liquid separators 26. A current density of 3 kA/m$^2$ is set using a power supply unit. The cell voltage being adjusted was measured with two graphite probes (not shown), each isolated from the supply, at the front edge of the electrodes.

After a run-in period of 5 days, the cell Voltage was 2.10 volts. The addition of an aqueous metal salt solution with a Pt content of 0.3 mg and a Pd content of 0.6 mg immediately lowered the voltage by about 0.4 volts. The voltage remained at this level for about 100 days and then slowly increased again to the original value before doping. Increasing the rate of flow of electrolyte to 35 l/h led to a more rapid increase in voltage after addition of the solution, returning to the value before doping within 1 to 2 days. This produced an average voltage of about 1.90 volts (start: 2.10 volts; drops to 1.70 V; returns to 2.10 V).

EXAMPLE 2

(according to the invention)

0.236 g of $IrCl_4.H_2O$ (Ir content about 50.9%) were dissolved in 1.0 ml of 1,2-ethanediol. Using a brush, this solution was uniformly applied to a graphite plate with grooves (FIG. 1) and with the external dimensions (110×73) mm$^2$. After an interval of about 5 minutes (time for the solution to penetrate into the pores in the graphite), the side soaked with solution (later the cathode side during electrolysis) was heated for about 6 minutes with a flame which covered the entire surface, the start temperature of 180° C. being reached within a few seconds and a temperature of 450° C. being reached after 6 minutes and the plate having already been arranged underneath the burners before igniting the flames. After cooling, the plate was again uniformly painted with 1 ml of pure 1,2-ethanediol and the heating procedure described above was repeated. The graphite plate was installed in the electrolysis cell. With rates of flow of electrolyte of 0.1 to 35 l/h, a cell voltage of 1.55 volts was set and this remained constant over several-months. During electrolysis the rate of corrosion was 1 μg Ir/l of electrolyte, and in the currentless state was 400 μg Ir/l of electrolyte.

EXAMPLE 3

(according to the invention)

0.118 g of $IrCl_4.H_2O$ and 0.150 g of $H_2PtCl_6.6H_2O$ were dissolved in 1.0 ml of 1,2-ethanediol and this solution was uniformly applied to a graphite plate (110×73) mm$^2$. Subsequent treatment took place as described in Example 2.

The graphite plate was installed as cathode in an HCl electrolysis cell with a diaphragm (FIG. 3). With rates of flow of electrolyte of 0.1 to 35 l/h, a cell voltage of 1.45 volts was set and this remained constant over several months. During electrolysis the rate of corrosion was 1 μg Pt/l and 2 μg Ir/l of electrolyte, and in the currentless state was 18,000 μg Pt/l and 20,000 μg Ir/l of electrolyte.

EXAMPLE 4

(according to the invention)

0.31 g of $RhCl_3.H_2O$ (Rh content about 0.12 g) were dissolved in 1.0 ml of 1,2-ethanediol. After application by brush onto a graphite plate, the Rh metal was sealed into the pores of the graphite as described in Example 2. This plate, used as cathode, produced a cell voltage of 1.67 volts which remained constant for 10 days.

EXAMPLE 5

(according to the invention)

0.236 g of $IrCl_4.H_2O$ were dissolved in 2 ml of 1,2,3-propanetriol and the solution uniformly applied to the graphite plate. Heating took place as described in Example 2. A cell voltage of 1.60 volts was set. The corrosion rate was the same as is described in Example 2.

EXAMPLE 6

(according to the invention)

In two cells, each with a cathode in accordance with Example 2 and 3 respectively, a residual current of 0.63 $mA/cm^2$ of cathode surface was obtained when the cell was not operating, corresponding to a residual voltage of 1.1 to 1.2 volts. The corrosion rate in the cell with an Ircoated cathode was 2 μg Ir/l and in that with a Pt-coated cathode was 6 μg Ir/l and 3 μg Pt/l.

It will be understood that the specification and examples are illustrative but not limitative of the present invention and that other embodiments within the spirit and scope of the invention will suggest themselves to those skilled in the art.

We claim:

1. In the preparation of a graphite body suitable for use as a cathode in an electrolytic process, comprising the steps of a) contacting a graphite body with a solution in one or more polyhydric alcohols having 2 to 4 carbon atoms of one or more salts of iridium or rhodium for a time sufficient for the solution to penetrate through the surface of the graphite body to a depth of at least about 1 mm, and b) heating and then cooling the graphite body, the improvement which comprises effecting the heating by contacting the surface of the graphite body into which the solution has penetrated with a naked gas flame positioned above such surface, the graphite body being heated to about 200° to 450° C. for about 2 to 10 minutes.

2. A process according to claim 1, wherein the solution of the iridium or rhodium salt additionally contains a salt of at least one member selected from the group consisting of platinum, palladium, osmium and ruthenium.

3. A process according to claim 2, wherein between (a) and (b) the graphite body is rinsed with at least one polyhydric alcohol having 2 to 4 carbon atoms, after cooling the graphite body is contacted with at least one polyhydric alcohol having 2 to 4 carbon atoms, again heated with the naked gas flame and then cooled, and the polyhydric alcohol comprises 1,2-ethanediol or glycerine.

4. A process according to claim 1, wherein the polyhydric alcohol comprises 1,2-ethanediol or glycerine.

5. A process according to claim 1, wherein after cooling the graphite body is contacted with at least one polyhydric alcohol having 2 to 4 carbon atoms, again heated with the naked gas flame and then cooled.

6. A process according to claim 1, wherein between (a) and (b) the graphite body is rinsed with at least one polyhydric alcohol having 2 to 4 carbon atoms.

* * * * *